US008668201B1

(12) United States Patent
Roudy et al.

(10) Patent No.: US 8,668,201 B1
(45) Date of Patent: Mar. 11, 2014

(54) TEMPORARY TATTOO GAME PIECE FOR A FIGHTING GAME AND METHOD OF PLAY

(71) Applicants: Ludovic Roudy, Paris (FR); Bruno Sautter, Paris (FR)

(72) Inventors: Ludovic Roudy, Paris (FR); Bruno Sautter, Paris (FR)

( * ) Notice: Subject to any disclaimer, the term of this patent is extended or adjusted under 35 U.S.C. 154(b) by 0 days.

(21) Appl. No.: 13/671,698

(22) Filed: Nov. 8, 2012

(51) Int. Cl.
*A63B 71/00* (2006.01)

(52) U.S. Cl.
USPC ..... 273/148 R

(58) Field of Classification Search
None
See application file for complete search history.

(56) References Cited

U.S. PATENT DOCUMENTS

| | | | | |
|---|---|---|---|---|
| 4,211,420 | A * | 7/1980 | Quiroz | 273/260 |
| 4,309,036 | A * | 1/1982 | Alvey | 273/248 |
| 5,578,353 | A | 11/1996 | Drew, III | |
| 6,042,881 | A | 3/2000 | Ewan | |
| 6,182,967 | B1 * | 2/2001 | Green | 273/290 |
| 6,964,229 | B1 | 11/2005 | Zimmerman | |
| 6,967,566 | B2 * | 11/2005 | Weston et al. | 340/323 R |
| 7,011,401 | B2 | 3/2006 | Markey | |
| 7,767,894 | B1 | 8/2010 | Diakoulas | |
| 2004/0239031 | A1 * | 12/2004 | Dewa et al. | 273/260 |
| 2008/0220195 | A1 | 9/2008 | Henshaw | |
| 2010/0148441 | A1 * | 6/2010 | Siciliano et al. | 273/244 |
| 2013/0095902 | A1 * | 4/2013 | Smith et al. | 463/11 |
| 2013/0260897 | A1 * | 10/2013 | Inuzuka | 463/42 |

* cited by examiner

*Primary Examiner* — Kurt Fernstrom
*Assistant Examiner* — Dolores Collins
(74) *Attorney, Agent, or Firm* — Young & Thompson

(57) ABSTRACT

A game piece for use by a player in a fighting game includes a support for an information compound, the information compound including a symbol associated with a fighting technique, and/or an identifiable determined background having a specific impact on the game ruling, and/or a bonus value symbol having a specific impact on the game ruling. The information compound support is a temporary body transfer device, such as a temporary tattoo, that is applicable on a visible part of the body of the player. A method of playing a fighting game using such game pieces includes the steps of providing each one of at least two players with at least one of the game pieces, each player applying at least one game piece on a visible part of his body, and starting to play the fighting game.

15 Claims, 3 Drawing Sheets

TEMPORARY TATTOO GAME PIECE FOR A FIGHTING GAME AND METHOD OF PLAY

TECHNICAL FIELD

The present invention generally pertains to games that combine chance and strategy and game pieces, such as "cards", that enable a player to form one or several combinations that competes against the combinations of other players.

Such games are generally for two or more players.

The game components include at least one rule of play and a plurality of game pieces which can be acquired by the players and/or which can be freely traded among the population of the players, such that each player might obtain and construct their own set of game pieces to thereby compete against the set of game pieces of an another player, or of other players.

The invention concerns such a game and also a method of play of such a game and alternative embodiments of the same including different game formats such as electronic games, interactive networks, and computer software.

At the present, there are mostly known games that use hand-holdable cards which do not easily permit any physical involvement of the player, and more particularly any use of his body, or part(s) of his body.

SUMMARY OF THE INVENTION

The invention proposes a game piece for use by a player in a fighting game comprising:

- a support for an information compound, said information compound comprising at least one element chosen among:
- a symbol associated with a fighting technique;
- an identifiable determined background having a specific impact on the game ruling;
- a bonus value symbol having a specific impact on the game ruling, and wherein said information compound support is a temporary body transfer device that is applicable on a visible part of the body of the player.

According to the invention, the game piece is supported by the player on his body and does not need to be transported independently and the fighting game can be played anywhere, without need for a game table, neither any specific surface or arrangement on a table or on the ground.

The fact that the game pieces are present on the player's skin and easily visible to anyone does permit an immediate recognition between players.

Of relevance to this disclosure is the practice of applying a product to a person's skin, and more particularly a game piece. One field of particular relevance is that of temporary tattoos.

Such tattoos are described by U.S. Pat. No. 6,042,881—Temporary tattoo and method for manufacturing same-Frederick R. Ewan.

The functional use of temporary tattoos beyond ornamental purposes is taught in U.S. Pat. No. 5,578,353—Tattoo admission ticket—James H. Drew, III. U.S. Pat. No. 5,578,353 teaches the advantageous use of temporary tattoos to identify a person having paid admission to an event.

Additionally, U.S. Pat. No. 7,011,401—Under-eye anti-glare sport tattoos—Stephen A. Markey, III, teaches the use of temporary tattoos as a means for reducing glare associated with the sun or stadium lights while incorporating space for advertising.

U.S. Pat. No. 6,964,229—Method for recording multi-event sports meet information on skin—Terri Chassay "T. C." Zimmerman, teaches a method using an ink stamp or a temporary tattoo to produce a means convenient for displaying swim meet event information on a swimmer's skin.

U.S. Pat. Appln. No 2008/0220195 teaches an athletic information display on the skin of an athlete in the form of a temporary tattoo, and U.S. Pat. No. 7,767,894 teaches a musical guide for guitars including playing data and information in the form of a temporary tattoo or sticker.

The invention also proposes a method of playing a fighting game using game pieces according to the invention, the method comprising the steps consisting in:

- providing each one of at least two players with a plurality of said game pieces;
- each player applying least one game piece on a visible part of his body
- starting to play the fighting game.

BRIEF DESCRIPTION OF THE DRAWINGS

One example of the invention will be described in details with reference to the attached drawings in which.

DETAILED DESCRIPTION

The present invention pertains to a fighting, or battling game for two or more players wherein the players engage in successive fights or assaults against each other in an attempt to defeat one another and to acquire winning points to reach a final winning score.

The invention concerns a so called fighting game or battle game, but is not limited to a gun fighting or to a duelist battle, but also concerns any game play such as a sport game, a spy game, etc.

Each player uses a variety of game pieces according to the invention that enable him or her to alter their fighting status and/or to modify the rule(s) of play.

The invention is thus directed not only to the specific game pieces in the form of temporary body transfer devices, such as temporary tattoos, but the invention is also directed to a method of playing a game using such game pieces.

Figure 1:
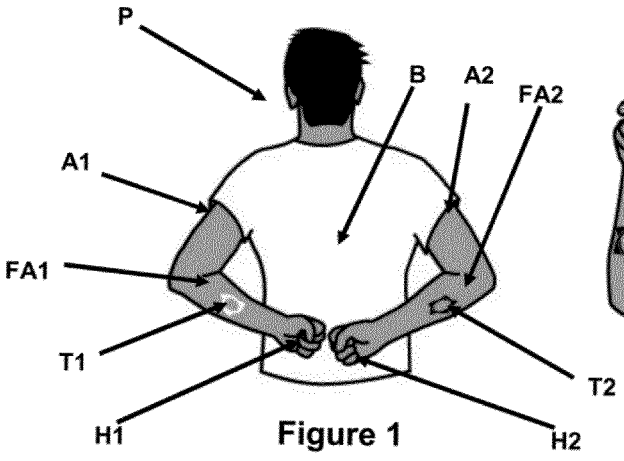
FIG. 1 is a back view showing one player during the Salute.

FIG. 1 is a rear view of one player P illustrated in his initial starting position (Salute Position) having his two arms A1 and A2 hidden in his back B—both arms being passive arms—so that any other player facing him can not see his two forearms FA1 and FA2, neither his two hands H1 and H2. The player has his two hands hidden and closing his fists.

According to one example of the invention, the inner face of each one of his forearms FA1 and FA2 is provided with a temporary tattoo T1 and T2 respectively.

It is necessary that each tattoo be placed on a visible part of the body, i.e. on a part of the body which can be initially hidden, but which can thereafter be shown or displayed to any other player simultaneously with the display of an associated playing hand.

Figure 2:
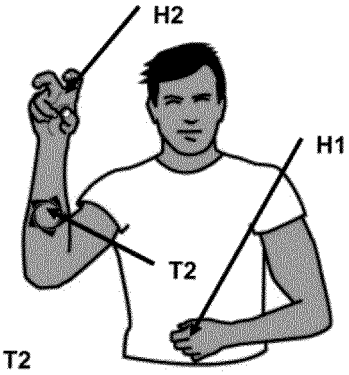
FIG. 2 is a front view of a player showing a selected fighting technique.

In the illustrated example, each inner face of one forearm FA1 or FA2—on which a temporary tattoo T1 or T2 has previously been applied—can be hidden in the back of the player together with the associated hand H1 or H2 and can be shown to any other player together with the associated hand by moving the corresponding arm in an active position in front of him as illustrated at FIG. 2.

In such an active or fighting position, any other opponent player can distinctively see one hand H1 of the player with a specific arrangement of his fingers F and also see the tattoo T1 previously applied on the inner face of the forearm FA1.

It is to be noted that in such a position, the player has the possibility to keep the inner face of his other forearm of his other arm A2 hidden in a passive position as in the illustrated position, or in his back, and also keeping his associated hand H2 without any specific visible arrangement of the fingers.

Figure 3:
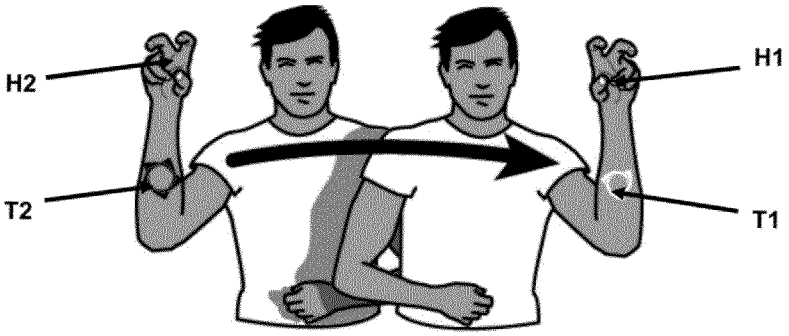
FIG. 3 is a front view of a player who is commuting his active arms.

Since each one of the two forearms is provided with an associated tattoo, it is possible for the player to choose any one of his two arms when adopting a Fighting Position and it is also possible to commute the two arms, as illustrated at FIG. 3.

According to the invention, each temporary tattoo, also called "POWER TATTOO" (Registered Trademark) is a symbol representing an attack parameter.

Some of the temporary tattoos comprise a symbol which is associated with a herein under called "Fighting Technique".

By way of example, there are here five basic fighting techniques among which each one corresponds to a number of fingers between one and five and to a specific arrangement of the corresponding number of fingers of one hand of the player.

Figure 4:
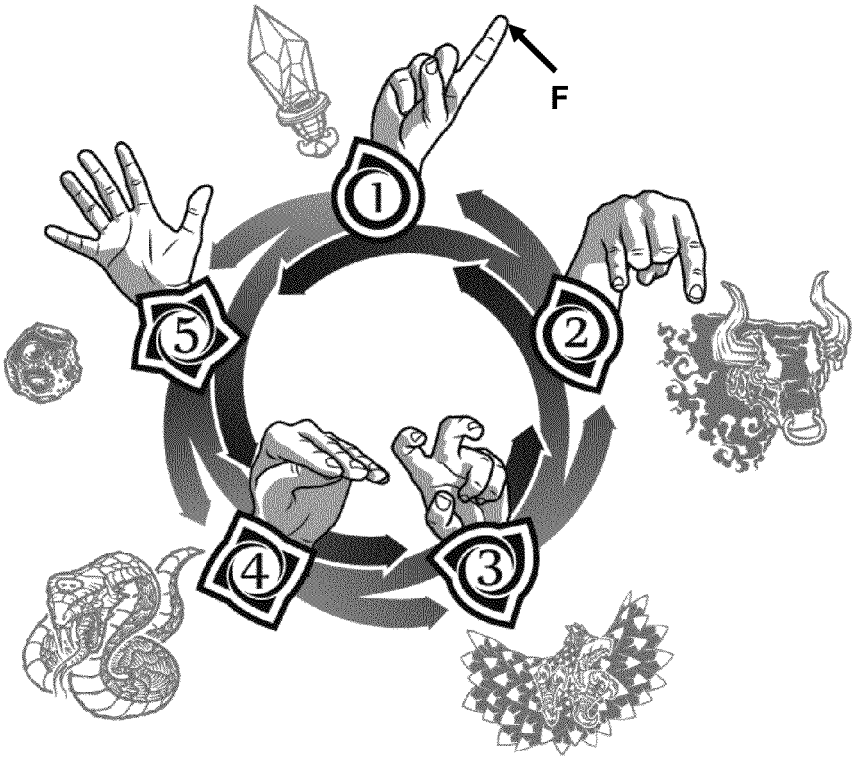
FIG. 4 is a scheme illustrating five fighting techniques together with their associated distinct symbols that are represented in a cyclic and hierarchized arrangement according to the invention.

FIG. 4 illustrates an example of the said five fighting techniques together with their associated distinct symbols that are represented in their cyclic and hierarchized arrangement according to the invention.

The "Sword": The first fighting technique 1 is the Sword corresponding to the display of only one finger F of the fighting hand, preferably the forefinger.

The "Bull": The second fighting technique 2 is the Bull corresponding to a specific display of only two fingers of the fighting hand, preferably the forefinger and the little finger.

The "Eagle": The third fighting technique 3 is the Eagle corresponding to a specific display of only three fingers of the fighting hand, preferably the forefinger, the middle finger and thumb.

The "Snake": The fourth fighting technique 4 is the Snake corresponding to a specific display of only four fingers of the fighting hand, preferably without displaying the thumb.

The "Comet": The fifth fighting technique 5 is the Comet corresponding to a specific display of the five fingers of the fighting hand.

Figure 5:
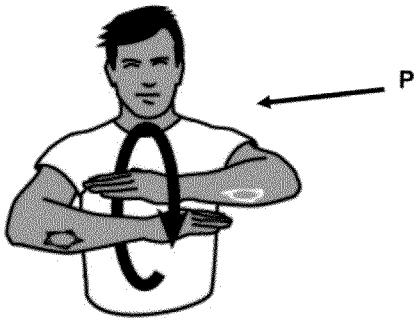
FIG. 5 is a front view showing a player who is passing.

All these five techniques are numerically hierarchized and according to a cycle such as illustrated by the various arrows at FIG. 5.

According to the basic rule of play, each fighting technique supersedes, over the two fighting techniques that are immediately "inferior".

Each fighting technique used by one player is thus a winning technique against a fighting technique used by an other player having an inferiorly ranked fighting technique.

The Comet fighting technique 5 (five fingers) is winning over the Snake 4 (four fingers) and also over the Eagle 3 (three fingers)

The Snake fighting technique 4 (four fingers) is winning over the Eagle 3 (three fingers) and also over the Bull 2 (two fingers).

The eagle fighting technique 3 (three fingers) is winning over the Bull 2 (two fingers) and also over the Sword 1 (one finger).

The Bull fighting technique 2 (two fingers) is winning over the Sword 1 (one finger) and also over the Comet 5 (five fingers).

The Sword fighting technique 1 (one finger) is winning over the Comet 5 (five fingers) and also over the Snake 4 (four fingers).

The names and illustrations are given here only by way of an example, and can be modified within the scope of the present invention, each one of the five fighting techniques however corresponding to a distinct number of fingers comprised between 1 and 5 of a hand. A fighting technique with 0 finger (a closed fist) or using a number of fingers between 0 and 10 (using two hands) is also within the scope of the invention.

The symbols and names of the fighting techniques are of course associated with the theme of the game. For example, a fighting game or battle game based on the "Far West" theme could include symbols such as "Gun" associated with three fingers, "Sheriff Star" associated with five fingers, etc.

Each tattoo is thus a support of a single fighting technique symbol chosen among the above mentioned five distinct symbols and/or a playing information, and/or a playing parameter, according to the invention.

Additionally, each tattoo may include other playing information such as an identifiable determined colored background having a specific impact on the game ruling and/or a bonus value symbol having a specific impact on the game ruling, as it will be explained later in details.

In the sense of the invention, a temporary tattoo is a non permanent body transfer device constituting a game piece which can initially be acquired or purchased or exchanged by a future player, individually or among a set of game pieces, and which can thus be applied by the player on the inner face of one of his or her forearms.

The playing information can be displayed in the form of a temporary tattoo or other media that is transferable to a person's skin.

It should be noted, that one embodiment of the game piece is a temporary tattoo for which, in its packaged form, the image will appear reversed in order to correctly display the information when transferred to the player's skin.

Various methods now exist for producing and then applying temporary tattoos. These methods include first, water slide decals that transfer a tattoo to a person's skin after soaking in water, second custom printed and cut labels that a person peels off a release sheet and then applies to the person's skin, and third, stamp pad tattoos applied to a person's skin after pressing a stamp upon an ink pad.

The water slide decals have information printed upon a transparent material. The material carries the information upon one surface and an adhesive upon the surface of the information in contact with the material. Placing the material in water loosens the adhesive so the decal often floats upon the water surface. A person then grasps an edge of the decal and places the decal upon their skin. The decal then dries and the adhesive binds to the skin and hair of the person.

The custom label tattoos posses information printed upon a substrate adhered to a release liner. A person then removes a selected label tattoo having desired information from the release layer and places the label upon their skin.

Stamped tattoos use a stamp with information reverse incised into the stamp's material. Generally the stamp has the image reversed so that a positive image appears upon the person's skin. A person then grips the stamp and places it upon an ink pad for the stamp to adsorb ink. Then the person places the inked stamp upon their skin to transfer the inked image.

One example of a rule game and of the method of playing will now be described in details with reference to a battle or fight between two players, comprising several phases or assaults.

Salute

At the beginning of a play or battle, and thereafter at the beginning of each assault, each one of the players P places himself facing his or her opponent, in the position illustrated at FIG. 1 with their fists closed in their back.

The two facing players salute each other by shouting a "Salute" such as "PO" "WER" "TATTOO".

Elect a Fighting Technique

After the very end of the Salute shouting, and simultaneously, each player chooses one of his arms, and consequently one of his hands to elect, realize, one of the five fighting techniques and each player displays, reveals, his chosen fighting technique by adopting a new active position as illustrated at FIG. 2.

The player makes a comparison between the two displayed fighting techniques.

The player who has the stronger and thus winning, fighting technique wins the Advantage authorizing him to be the attacker during the coming assault.

In case of draw, the two players salute again and repeat a simultaneous election of their fighting technique.

Assault or Attack

One after the other, starting with the player who has won the Advantage, each player attacks to win points (or decides to pass), and this until one of the players reaches a five points score or mark.

In order to attack, the player keeps his fighting technique, but commutes his two arms, forearms and hands, as illustrated at FIG. 3.

Therefore, his previously active arm becomes his passive arm and conversely his previously passive arm becomes his active arm.

But the arrangement of the fingers of his visible new active hand is identical to the one of his previously active hand, thus keeping in force his fighting technique.

The opponent player, or defender, has no right to modify his status and position, i.e. he must keep his fighting technique and arm position resulting from the election of the simultaneous fighting technique at the end of the Salute.

The attacker applies the combination of his elected fighting technique and of the POWER TATTOO displayed on his visible active forearm in order to determine a Final fighting technique, depending on the various information of the tattoo and on the rule of play as it will be explained hereinafter.

If the attacker is winning, he computes one or two points.

Then normally comes the turn for the other player (competitor) to play (or pass).

Pass

On his turn, a player might decide to pass showing his decision according to a rotating movement of his arms as illustrated at FIG. 5.

If the player has decided to pass, a new assault begins with a new Salute.

In the case where, in this next assault, the two players reveal simultaneously the same fighting technique, then the competitor of the player who passed in the previous assault does immediately score 1 point.

Examples and Details of Various POWER TATTOOS, of Additional Information on a POWER TATTOO, and of Impacts on an Assaults Issues The following examples are given by way of example with respect to a temporary tattoo on which the symbol is a Bull and refers to the "Bull fighting technique" using two fingers.

Figure 6G:
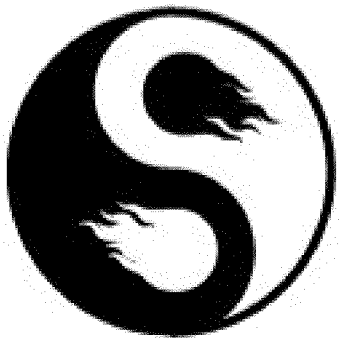
FIGS. 6A to 6G are schemes showing examples of seven various POWER TATTOOS according to the invention.
Figure 6A:
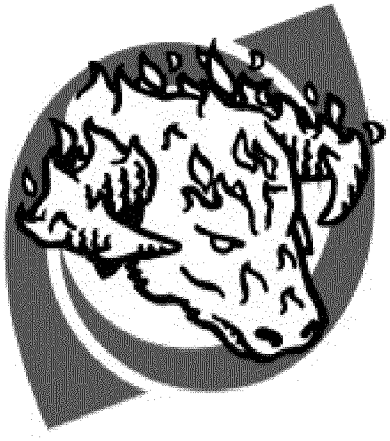

A) the Fighting Technique Associated POWER TATTOO Symbol is Surrounded by a White Background—FIG. 6A If the fighting technique of the attacker is a Bull (two fingers) and if the POWER TATTOO fighting technique symbol is a Bull with a white background, the player has the right and possibility to modify his fighting technique by adding or retrieving one finger and thus can transform his "Bull" fighting technique (two fingers) in an "Eagle" (adding one finger) or in a "Sword" (retrieving one finger).

Figure 6B:
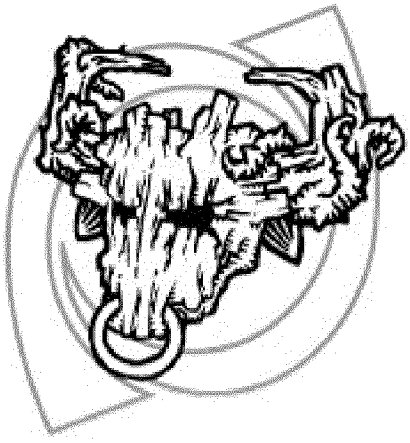

B) the Fighting Technique Associated POWER TATTOO Symbol is Surrounded by a Colored (Non White) Background—FIG. 6B If the fighting technique of the attacker is identical to the fighting technique symbol and if this fighting technique is winning over the fighting technique of the defender, the attacker wins two points instead of one point.

For example, if the fighting technique of the attacker is a Bull and if the POWER TATTOO fighting technique symbol is a Bull with a colored background and if the fighting technique of the defender is the Sword or the Comet, then the attacker wins two points (instead of one point).

Figure 6C:
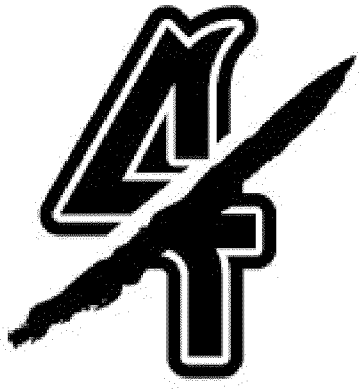

C) the POWER TATTOO Represents a Bonus Value Symbol which is a Crossed Over Number of Fingers—FIG. 6C If the fighting technique of the defender comprises a number of fingers which is equal to the crossed over number of fingers on the active arm of the attacker, the defender must pass when it is his turn to act. In the example of FIG. 6C, the crossed over number is the number "4".

For instance, if the attacker has the crossed number "4" on his active arm and if the fighting technique of the defender is the Snake (four fingers) then the defender will have to pass when his turn will come.

Figure 6D:
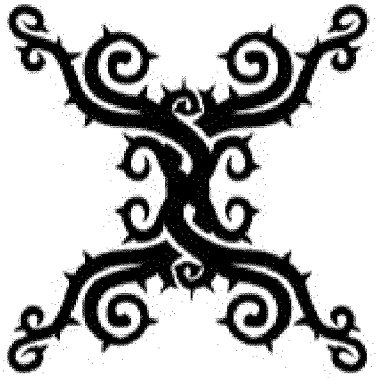

D) the POWER TATTOO Represents a "Thorny Bramble"—FIG. 6D

If the POWER TATTOO of the attacker is a "Thorny Bramble" as illustrated at FIG. 6D, and if the defender decides to pass when his turn comes, then the attacker scores one point.

Figure 6E:
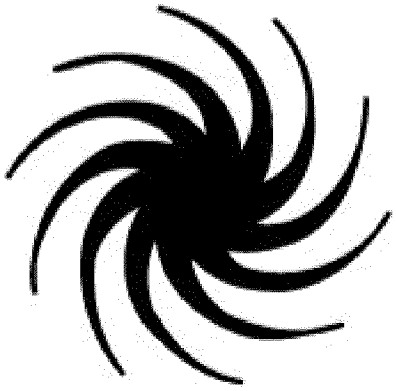

E) the POWER TATTOO Represents a "Vortex"—FIG. 6E

If the POWER TATTOO of the attacker is a "Vortex" as illustrated at FIG. 6E, the defender must immediately change his active arm by commuting his arms keeping his previously selected fighting technique, but he will thus not have the possibility to use the POWER TATTOO that he was expecting to use on this turn.

Figure 6F:
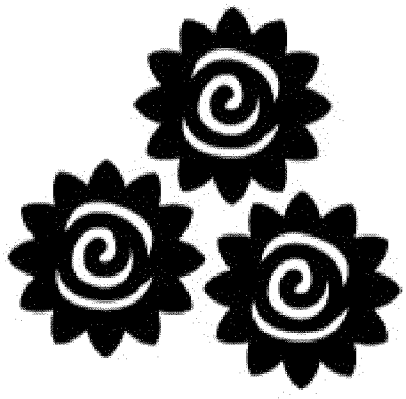

F) The POWER TATTOO Represents "Water Lily Flowers"—FIG. 6F

If the POWER TATTOO of the attacker are "Water lily Flowers" as illustrated at FIG. 6F, and if the fighting technique of the player is a loosing technique superseded by the fighting technique of his opponent, the opponent must pass when it is his turn to act.

G) the POWER TATTOO is the "Ying Yang" Symbol—FIG. 6G

If the POWER TATTOO symbol of the attacker is the "Ying Yang" symbol as illustrated at FIG. 6G, and if the fighting technique of the attacker is a winning technique over the fighting technique of the defender and if the defender has more points than the attacker, then the attacker wins two points (instead of one point).

The combined use of the possibility to "display" various fighting techniques, and of his or her POWER TATTOOS on his or her arms, and of the POWER TATTOOS of his or her competitor, provides each player with an infinity of strategies, including bluffing.

The invention is not limited to the preferred embodiment which has been described. Any game piece according to the invention can be used in any game played along the method according to the invention, the players just touching their hands and having the effects of their tattoos acting in an assault, without announcing any specific "fighting technique".

The invention claimed is:

1. A game piece for use by a player in a fighting game comprising:

a support for an information compound, said information compound comprising at least one element chosen among:

a symbol associated with a fighting technique;

an identifiable determined background having a specific impact on the game ruling;

a bonus value symbol having a specific impact on the game ruling, and wherein said information compound support is a temporary body transfer device that is applicable on a visible part of the body of the player.

2. A game piece according to claim 1 wherein the said part of the body of the player is the inner face of at least one of his forearms.

3. A game piece according to claim 1, wherein said body transfer device is a temporary tattoo.

4. A game piece according to claim 1, wherein said fighting technique symbol is chosen among several distinct symbols each one being associated with a different numerical value chosen between zero and ten, each one corresponding to an associated number of fingers of one or two hands of the player, and wherein said distinct symbols are hierarchized along a cyclic arrangement and according to their increasing associated numerical values.

5. A game piece according to claim 4, wherein said fighting technique symbol is chosen among five distinct symbols each one being associated with a different numerical value chosen between one and five, each one corresponding to an associated number of fingers of one hand of the player, and wherein said five technique symbols are hierarchized along a cyclic arrangement and according to their increasing associated numerical values.

6. A game piece according to claim 4, wherein a hierarchized fighting technique supersedes the two immediately inferior hierarchized fighting techniques.

7. A game piece according to claim 5, wherein a hierarchized fighting technique supersedes the two immediately inferior hierarchized fighting techniques.

8. A game piece according to claim 1, wherein said identifiable determined background having a specific impact on the game ruling is a colored background having a color chosen among at least two colors.

9. A method of playing a fighting game using game pieces according to claim 1, the method comprising the steps consisting in:

providing each one of at least two players with at least one of said game pieces;

each player applying least one game piece on a visible part of his body starting to play the fighting game.

10. A method according to claim 9, wherein each player applies at least one game piece on each one of his two forearms.

11. A method according to claim 10, wherein starting to play the fighting game includes firstly in determining a starting player by/through, for each player, choosing an initial active arm among his two arms, and in choosing and displaying a specific arrangement of a determined number of fingers of the hand of said chosen initial active arm corresponding to an associated (elected) fighting technique, for determining the starting player according to said hierarchy, each player hiding his other passive arm.

12. A method according to claim 11, wherein starting the fighting game further includes, for the starting player, to start an assault and to attack his opponent, or to pass.

13. A method according to claim 11, wherein said determination of a starting player is repeated in case of draw.

14. A method according to claim 12, wherein the starting and attacking player starts an assault by commuting his active arm and keeping his previously chosen fighting technique, therefore hiding his previously active arm and showing to his opponent:

an active attacking arm having at least one visible game piece on the forearm; and the said specific arrangement of a determined number of fingers of the hand of said active arm corresponding to an associated (elected) fighting technique;

and the opponent keeps his initial active arm therefore showing to the attacking player:

an active arm having at least one visible game piece on the forearm; and the said specific arrangement of a determined number of fingers of the hand of said active arm corresponding to an associated (elected) fighting technique.

15. A method according to claim 14, wherein the result of said assault is determined according to the rule of the fighting game taking into account:

the said fighting technique and visible game piece of the attacking player; and the said fighting technique of the opponent.

* * * * *